US006202762B1

(12) United States Patent
Fehr et al.

(10) Patent No.: US 6,202,762 B1
(45) Date of Patent: Mar. 20, 2001

(54) FLOW RESTRICTOR VALVE FOR A DOWNHOLE DRILLING ASSEMBLY

(75) Inventors: James Fehr, Sherwood Park; Steven Park, Edmonton, both of (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/305,438

(22) Filed: May 6, 1999

(30) Foreign Application Priority Data

May 5, 1999 (CA) ..... 2270856

(51) Int. Cl.[7] ..... E21B 4/02
(52) U.S. Cl. ..... 175/107
(58) Field of Search ..... 175/107, 26, 232, 175/57, 317, 95, 96; 418/48; 415/25; 173/176, 8, 9

(56) References Cited

U.S. PATENT DOCUMENTS

| | | |
|---|---|---|
| 3,194,325 | 7/1965 | Gianelloni . |
| 3,840,080 | 10/1974 | Berryman . |
| 3,964,558 | 6/1976 | Fogle . |
| 4,298,077 | 11/1981 | Emery . |
| 4,339,007 | 7/1982 | Clark . |
| 4,660,655 | 4/1987 | Warren . |
| 4,768,598 | 9/1988 | Reinhardt . |
| 5,174,392 | 12/1992 | Reinhardt . |
| 5,351,766 | 10/1994 | Wenzel . |
| 5,806,611 | 9/1998 | Van Den Steen et al. . |

FOREIGN PATENT DOCUMENTS

| | | |
|---|---|---|
| 2056043 | 5/1993 | (CA) . |
| 2082488 | 5/1993 | (CA) . |
| 2071612 | 12/1993 | (CA) . |
| 762749 | 12/1956 | (GB) . |
| WO96/38653 | 12/1996 | (WO) . |

OTHER PUBLICATIONS

Sperry–Sun Drilling Services, Inc., "Sperry Drill Technical Information Handbook," undated, pp. 2–17.

*Primary Examiner*—Robert E. Pezzuto
(74) *Attorney, Agent, or Firm*—Terrence N. Kuharchuk; William Shull; Michael D. McCully

(57) ABSTRACT

An improved drilling assembly of the type comprising a fluid driven motor, a driveshaft operatively connected with the motor, a housing for enclosing the driveshaft and an annular flow passage defined between the driveshaft and the housing for circulating drive fluid therethrough. The improvement comprises a drive fluid flow restrictor device comprising a constricted section in the annular flow passage, an expanded section in the annular flow passage and a valve member positioned in the annular flow passage. The valve member is movable axially in the annular flow passage between the constricted section and the expanded section to define a flow restricting position and a normal flow position When the valve member is in the flow restricting position the circulation of drive fluid through the annular flow passage is restricted. When the valve member is in the normal flow position the circulation of drive fluid through the annular flow passage is relatively unrestricted.

13 Claims, 3 Drawing Sheets

FLOW RESTRICTOR VALVE FOR A DOWNHOLE DRILLING ASSEMBLY

FIELD OF INVENTION

The present invention relates to a drive fluid flow restrictor device or valve for use in a downhole drilling assembly of the type comprising a fluid driven motor. Further, the drilling assembly preferably comprises a driveshaft operatively connected with the motor, a housing for enclosing the driveshaft and an annular flow passage defined between the driveshaft and the housing for circulating drive fluid therethrough and wherein the flow restrictor device controls by restricting, either partially or completely, the circulation of drive fluid through the annular flow passage.

BACKGROUND OF INVENTION

Moineau pump type drilling motors or downhole positive displacement drilling motors are extensively used for drilling boreholes from the surface to a desired location within a selected underground hydrocarbon producing formation. To operate the drilling motor, a pressurized fluid is pumped into and circulated through a progressing axial fluid cavity or chamber within the power unit of the motor formed between a helical-lobed rotor and a compatible helical-lobed stator comprising tile power unit. The force of the pressurized circulating fluid being pumped into the axial cavity between the rotor and stator causes the rotor to rotate within the stator. The rotation of the rotor is transferred to the drill bit through a driveshaft.

Various circulating fluids may be used to actuate the downhole motor, such as mud, water, air or other gases. Thus, the hydraulic or pneumatic energy of the pressurized circulating fluid is converted into the mechanical energy of the rotating driveshaft and the attached drill bit. Further, the bit rotation speed or rotations per minute ("RPM") is directly proportional to the circulating fluid flow rate between the rotor and stator. If for any reason the motor is operated above a maximum desirable RPM for the particular motor, there is a tendency for damage and increased or accelerated wear to the motor.

Excessively high or damaging RPMs of the driveshaft have been found to particularly occur in positive displacement motors operated or actuated by a compressible fluid such as air or other gases. Specifically, excessive RPMs have been found to occur whenever the motor is pulled up off of the bottom of the drilled borehole or the weight on bit is otherwise removed from the drill bit or significantly decreased such as when the weight on bit is drilled off.

The decreased weight on bit results in a runaway condition caused by the sudden lowering of the pressure and consequent expansion of the compressed fluid, such as the compressed gas or air, inside the drill string and motor normally present during the drilling mode or performance of the drilling operation. As indicated, the pressure drop across the motor's power unit, including the rotor and stator, normally provides the energy for the creation of the rotary motion of the driveshaft and bit when torque is generated at the bit in the drilling mode. Thus, an excessive or sudden reduction in pressure within the motor has a tendency to create excessive RPMs of the driveshaft. In other words, the decreased weight on bit reduces the torsional resistance to the rotor of the motor, which reduces the pressure resistance and thus the pressure within the motor. The reduction in pressure within the motor permits the expansion of the compressed fluid resulting in excessive motor speed and rotation of the driveshaft.

This runaway condition is particularly prevalent when the motor is actuated by compressed air or gas as compared with the same motor driven by a flow of drilling mud. In fact, it has been found that runaway RPMs when utilizing compressed air or gas can be as high as 5 to 8 times the rated maximum RPM for the motor. Consequently, serious damage and accelerated wear results to both the rotating and stationary parts comprising the motor.

Several devices and systems exist for controlling the flow of drilling fluid through the power unit which are dependent upon and reactive to the pressure of the drive fluid within the motor.

For instance, U.S. Pat. No. 4,339,007 issued Jul. 13, 1982 to Clark describes a control system for a progressing cavity hydraulic downhole drilling mud motor for controlling the pressure drop of the fluid through the motor so that it does not become excessive (such as may be caused by increased torsional resistance of the rotor). The control system includes a valve sub attached to an upper end of a power unit including a rotor and stator, which valve sub is located above the rotor and the stator. The valve sub comprises a valve housing secured to the stator and a flow valve linked with the rotor and positioned within the valve housing to control the flow of fluid through the valve housing. The flow valve is movable between an open and closed position in response to the fluid pressure within the motor, however, the valve is normally biased towards the open position.

Further, U.S. Pat. No. 5,351,766 issued Oct. 4, 1994 to Wenzel also describes a flow restrictor for controlling the rate of mud flow through the bearing assembly of a mud lubricated drilling motor. In particular, a first seal, coupled to an outer housing, is biased by springs towards a second seal, coupled to an inner member, to bring it into sealing engagement therewith to form a mechanical seal having a first inner side and a second outer side. A first fluid flow passage extends from the interior of the inner member to the first side of the mechanical seal, while a second fluid flow passage extends from the second side of the mechanical seal to the exterior of the outer housing. A number of grooves extend from the first to the second side of the mechanical seal, which turns the mechanical seal into a flow restrictor.

In operation, drilling mud passes through the first fluid flow passage to the first side of the mechanical seal and then through the grooves from the first side to the second side of the mechanical seal. The mud is then vented to the exterior of the outer housing through the second fluid flow passage. The pressure with which the first seal and the second seal are engaged is determined by the biasing force of the springs applied to the seals. Therefore, the springs are selected based upon the desired flow rate through the mud motor.

U.S. Pat. No. 4,768,598 issued Sep. 6, 1988 to Reinhardt describes a valving apparatus for protecting a downhole fluid pressure motor from excessive fluid pressures within the motor, which apparatus is mounted directly above the motor. The apparatus includes a flow plug and a piston for shifting the position of the flow plug. Upon the occurrence of a predetermined fluid pressure across the motor, the fluid pressure moves the piston upwardly, which concurrently causes an upward movement of the flow plug to produce a flow constriction in the fluid flow path of the pressurized fluid. The upward motion of the piston also opens a bypass flow path around the motor to reduce the fluid pressure being applied to the motor.

If the operator responds to the excess pressure by raising the drill string at the surface, the fluid pressure will be reduced within the motor and the piston will move downwardly to its initial position. Downward movement of the piston results in downward movement of the flow plug and permits the fluid flow path through the motor to be re-established. Thus, the device is actuated by and reactive to the pressure within the motor.

These devices and systems are designed to control the pressure drop or the fluid flow through the motor or to control excessive pressure within the motor. They do not specifically address the runaway condition described above nor are they reactive to or actuated by the weight on bit. However, various attempts have been made to specifically address the runaway condition and to avoid the damage and wear caused by the resulting excessive RPMs. These attempts have not been completely satisfactory.

Several attempts to provide a solution to the runaway condition include a clutch mechanism or clutch arrangement to prevent rotation of the driveshaft when the weight on bit is reduced. For instance, Canadian Patent Application No. 2,071,612 published Dec. 19, 1993 by Wenzel describes a clutch mechanism for preventing an uncontrolled increase in the speed of a drilling motor during air drilling. The clutch mechanism is located within a lubricant filled bearing chamber defined between an outer housing and an inner mandrel. The bearing chamber is sealed to prevent drilling fluids from communicating with the chamber. The clutch mechanism includes a first clutch means secured to the interior of the housing and a second clutch means secured to the exterior of the inner mandrel.

When placed in compression during drilling, the first and second clutch means are spaced apart within the bearing chamber to permit the relative rotation of the housing and inner mandrel. When placed in tension, the first clutch means lockingly engages the second clutch means to prevent the relative rotation of the housing and inner mandrel. The clutch means are preferably comprised of mating teeth or splines to ensure relative rotation does not occur.

Further, U.S. Pat. No. 3,964,558 issued Jun. 22, 1976 to Fogle describes a downhole drilling device including a fluid turbine to produce torque and a positive displacement fluid motor to regulate the speed of an output shaft connected to both the turbine and the motor. Further, Fogle describes an over-running clutch to aid in start-up of the turbine and to prevent overspeed of the turbine. The clutch may be located anywhere in the drive train between the turbine and the motor and is generally described as a one-way overrunning clutch arrangement. No further description of the specific structure of the clutch arrangement is described.

Other solutions to the runaway condition described above have resulted in motors which have a relatively complex or complicated structure and mechanism of operation. For instance, U.S. Pat. No. 5,174,392 issued Dec. 29, 1992 to Reinhardt discloses an apparatus for controlling the power supplied to a drill bit by a downhole fluid powered motor to prevent the motor from rotating the bit at high speeds when there is little or no weight on bit. Further, the apparatus is specifically designed to prevent the high speed rotation of the drill bit while permitting full circulation through the bit. Specifically, when weight is removed from the bit, a bypass is opened and the fluid is directed past the motor and through the drill bit.

When fluid is circulated through the motor, the fluid is directed into the motor and is split into two flow paths. A first path is defined between the rotor and stator of the motor, while a second path is defined through a flexible member contained within the bore of the stator. A bypass seal or valve member is provided within the flexible member for selectively sealing the second flow path. The fluid paths again commingle below the location of the bypass seal or valve member via crossover ports extending between the first and second flow paths. The commingled fluid is then directed through the driveshaft to the drill bit.

The bypass seal is actuated by a centre rod extension which extends through the driveshaft from the bypass seal to an end adjacent the drill bit. The application of weight on bit acts upon the adjacent end of the centre rod extension and thereby moves or actuates the bypass seal.

When little to no weight is applied to the bit, the bypass seal is moved to a position within the bore of the driveshaft such that fluid is permitted to flow through the flexible member. As a result, due to the pressure resistance necessary to pass through the first flow path by rotating the rotor within the stator, the fluid tends to flow through the path of least resistance, being the second flow path. As a result, zero to slight rotation of the rotor only is experienced, while full circulation is maintained through the drill bit.

When weight is applied to the bit, the bypass seal is moved upward by the centre rod extension out of the bore of the driveshaft and into the flexible member for sealing engagement therewith. Drilling fluid cannot therefore pass through the second flow path through the flexible member and is forced into the first flow path, causing rotation of the rotor within the stator. When the motor is picked up off bottom or the weight on bit is drilled off, the bypass seal is again moved out of the flexible member to permit fluid flow and so that the fluid again bypasses the rotor and stator. Alternately, rather than closing the flexible member to prevent flow through the first fluid path, the bypass seal may only act to restrict the flow through the flexible member.

In an alternate embodiment of Reinhardt, as shown in FIG. 10, the bypass seal or valve member is located within the bore of the driveshaft below the level of the cross-over ports such fluid flowing through a fluid path defined between the rotor and stator is directed through the cross-over ports into the bore of the driveshaft. Thus, the bypass valve controls the passage or flow of the drilling fluid through the bore of the driveshaft.

In the alternate embodiment, when weight is removed from the bit, the bypass seal is moved downward to a position within a constricted portion of the bore of the driveshaft to seal therewith and prevent all fluid flow therethrough. Thus, the column of drilling fluid is held in the string. Alternately, the bypass seal may act only to restrict the fluid flow through the bore of the driveshaft. Conversely, when weight is applied to the bit, the weight pushes the bypass seal upwards out of engagement with the constricted portion of the bore of the driveshaft such that fluid may flow past the seal. Thus, fluid flow between the rotor and stator and through the driveshaft is permitted.

Thus, there remains a need in the industry for a device for controlling the runaway condition associated with downhole fluid driven drilling motors when weight on bit is removed from the drill bit. More particularly, there is a need for such a device for use with downhole fluid driven drilling motors, wherein the circulating drive fluid is comprised of compressed gas or air. Further, there is a need in the industry for a drive fluid flow restrictor device or valve for use in a downhole drilling assembly of the type comprising a fluid driven motor.

SUMMARY OF INVENTION

The present invention relates to a drive fluid flow restrictor device or valve for use in a downhole drilling assembly of the type comprising a fluid driven motor. Further, the drilling assembly preferably comprises a driveshaft operatively connected with the motor, a housing for enclosing the driveshaft and an annular flow passage defined between the driveshaft and the housing for circulating drive fluid therethrough and wherein the flow restrictor device controls by restricting, either partially or completely, the circulation of drive fluid through the annular flow passage.

The drive fluid flow restrictor device may be used in any downhole drilling assembly comprising a fluid driven motor. More particularly, the device may be used with any type of fluid driven motor or motor driven by a circulating fluid. Although the fluid driven motor may be driven by any circulating fluid such as mud, water, air or other gases, the drive fluid is preferably comprised of compressed air or other gases.

As well, although any fluid driven motor may be used, the motor is preferably of a type comprising a progressing axial fluid cavity or chamber formed between a helical-lobed rotor and a compatible helical-lobed stator. The force of the pressurized circulating drive fluid being pumped into the axial cavity between the rotor and stator causes the rotor to rotate within the stator. The rotation of the rotor is transferred to an attached drill bit through the driveshaft, which is operatively connected with the rotor.

In one aspect of the invention, the invention is comprised of an improved drilling assembly. The drilling assembly is of the type comprising a fluid driven motor, a driveshaft operatively connected with the motor, a housing for enclosing the driveshaft and an annular flow passage defined between the driveshaft and the housing for circulating drive fluid therethrough. The improvement to the drilling assembly comprises a drive fluid flow restrictor device, the device comprising:

(a) a constricted section in the annular flow passage;

(b) an expanded section in the annular flow passage; and (c) a valve member positioned in the annular flow passage, the valve member being movable axially in the annular flow passage between the constricted section and the expanded section to define a flow restricting position and a normal flow position;

such that when the valve member is in the flow restricting position the circulation of drive fluid through the annular flow passage is restricted and such that when the valve member is in the normal flow position the circulation of drive fluid through the annular flow passage is relatively unrestricted.

The valve member may be associated with either or both of the driveshaft or the housing, although preferably, the valve member is associated with either the driveshaft or the housing. Further, the valve member is preferably associated with a surface or surfaces of the driveshaft or housing adjacent to or defining the annular flow passage, such as an outer surface of the driveshaft or an inner surface of the housing.

In addition, the valve member may be comprised of any structure, mechanism or device movable axially within the annular flow passage and able to restrict the circulation of drive fluid through the annular flow passage when in the flow restricting position and to permit the circulation of drive fluid through the annular flow passage relatively unrestricted when in the normal flow position.

For instance, the valve member may be comprised of a projecting surface on either or both of the driveshaft or the housing. Preferably, each projecting surface projects from the driveshaft or the housing towards the other of the driveshaft or the housing. Thus, each projecting surface preferably projects into the annular flow space. In the preferred embodiment, the valve member is comprised of a projecting surface on either the driveshaft or the housing. More preferably, the valve member is comprised of a projecting surface on the driveshaft.

Further, the valve member may be associated with either the driveshaft or the housing in any manner such as by connecting, fastening, affixing or otherwise joining the valve member with the driveshaft or housing or by integrally forming the valve member therewith. Preferably, the valve member is integrally formed with either the driveshaft or the housing. Thus, in the preferred embodiment, the valve member is comprised of a projecting surface on the driveshaft integrally formed therewith.

Alternately, rather than being associated with the driveshaft or the housing or both, the valve member may be disposed between the driveshaft and the housing. The valve member may be disposed between the driveshaft and the housing in any manner permitting the movement of the valve member axially within the annular flow passage. The valve member disposed between the driveshaft and the housing may be comprised of any structure, mechanism or device movable axially within the annular flow passage and able to restrict the circulation of drive fluid through the annular flow passage when in the flow restricting position and to permit the circulation of drive fluid through the annular flow passage relatively unrestricted when in the normal flow position. For instance, in this alternative embodiment, the valve member may be comprised of a valve mandrel disposed within the annular flow passage between the driveshaft and the housing.

In addition, the constricted and expanded sections of the annular flow passage may be defined by one or more portions or sections of the driveshaft, the housing or both so long as the expanded section provides a flow area or cross-sectional area of flow greater than that of the constricted section and the valve member is permitted to move axially in the annular flow passage between the constricted section and the expanded section. Preferably, the constricted section of the annular flow passage is defined by a section of the housing having a reduced inner dimension relative to the inner dimension of the expanded section.

The valve member may move between the flow restricting position and the normal position in the annular flow passage in any manner and by any mechanism or method of actuation. However, the valve member preferably moves between the flow restricting position and the normal flow position in the annular flow passage as a result of axial movement of the driveshaft relative to the housing. The relative axial movement between the driveshaft and the housing may occur in any manner and may be a result of any mechanism or method of actuation. For instance, this relative axial movement may be a result of the circulation or the lack of circulation of drive fluid through the annular flow passage. However, preferably, the relative axial movement is a result of an increase or decrease of the weight on bit.

In the preferred embodiment, the driveshaft is capable of axial movement relative to the housing between an extended driveshaft position and a retracted driveshaft position, wherein the valve member is in the flow restricting position when the driveshaft is in the extended driveshaft position, and wherein the valve member is in the normal flow position when the driveshaft is in the retracted driveshaft position. Further, the driveshaft is preferably biased toward the extended driveshaft position.

Thus, in the preferred embodiment, when the weight on bit is increased, the driveshaft is moved axially relative to the housing towards the retracted driveshaft position, wherein the valve member is in the normal flow position permitting circulation of drive fluid through the annular flow passage relatively unrestricted. Conversely, when the weight on bit is decreased, the driveshaft is moved axially relative to the housing towards the extended driveshaft position, wherein the valve member is in the flow restricting position restricting circulation of drive fluid through the annular flow passage, either partially or completely.

Alternatively, where the valve mandrel is disposed between the driveshaft and the housing, the valve mandrel may move between the flow restricting position and the normal flow position in the annular flow passage as a result of axial movement of the valve member relative to both the driveshaft and the housing. The relative axial movement between the valve mandrel and the driveshaft and housing may occur in any manner and may be a result of any mechanism or method of actuation. For instance, this relative axial movement may similarly be a result of an increase or decrease of the weight on bit or a result of the circulation or the lack of circulation of drive fluid through the annular flow passage.

For instance, where the valve member is alternately disposed between the driveshaft and the housing, the valve member may be capable of axial movement relative to both the driveshaft and the housing between a distal valve mandrel position, defining one of the flow restricting position and the normal flow position, and a proximal valve mandrel position, defining the other of the flow restricting position and the normal flow position. The valve mandrel is preferably biased toward the flow restricting position.

Finally, the drilling assembly is further comprised of a drilling bit located at a distal end of the drilling assembly and preferably the device is located between the fluid driven motor and the drilling bit. However, the flow restrictor device may alternately be located at any other location in the drilling assembly compatible with and permitting the functioning of the device as described herein.

BRIEF DESCRIPTION OF DRAWINGS

Embodiments of the invention will now be described with reference to the accompanying drawings, in which.

DETAILED DESCRIPTION

Figure 1:
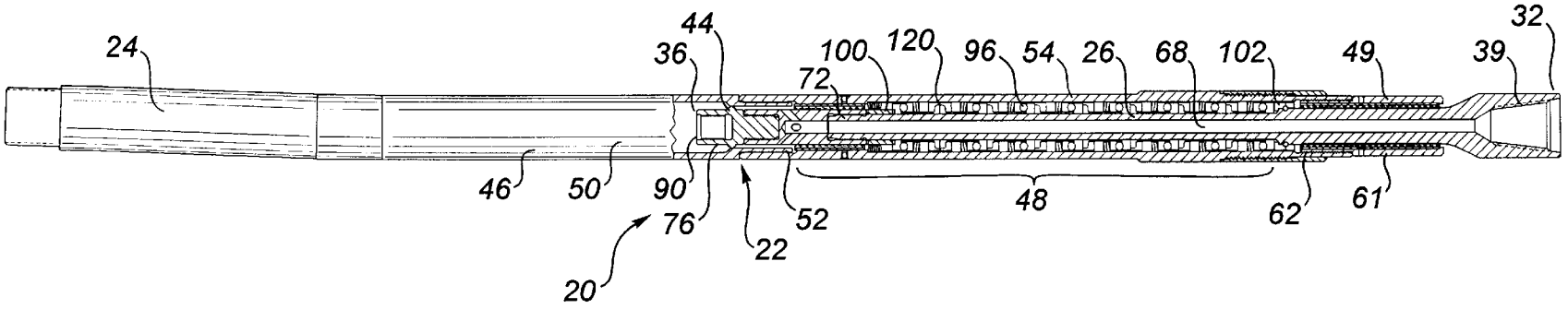
FIG. 1 is a longitudinal sectional view of a portion of a drilling assembly comprising a driveshaft and a housing and showing a preferred embodiment of a drive fluid flow restrictor device associated therewith.

Referring to FIGS. 1 through 5, the within invention comprises an improvement to a drilling assembly (20). More particularly, the improvement comprises a drive fluid flow restrictor device (22). The drilling assembly (20) is of a type comprising a fluid driven motor (24) and the flow restrictor device (22) is provided for restricting the flow of drive fluid, either partially or fully, through the motor (24).

The drive fluid flow restrictor device (22) may be used with any downhole drilling assembly (20) comprising a fluid driven motor (24). More particularly, the device (22) may be used with any type of downhole motor (24) driven by a circulating fluid. Various circulating fluids may be used to actuate the downhole motor (24), such as mud, water, air or other gases. However, the drive fluid is preferably comprised of compressed air or other gases.

Further, although the flow restrictor device (22) may be used with any fluid driven motor (24), the motor (24) is preferably a positive displacement type motor comprising a progressing axial fluid cavity or chamber formed between a helical-lobed rotor and a compatible helical-lobed stator. The force of the pressurized circulating drive fluid being pumped into the progressing axial cavity between the rotor and stator causes the rotor to rotate within the stator. Thus, the hydraulic or pneumatic energy of the pressurized circulating fluid is converted into the mechanical energy of the rotating rotor. Further, the rotations per minute ("RPM") of the rotor are directly proportional to the circulating fluid flow rate between the rotor and stator.

The drilling assembly (20) is further comprised of a driveshaft (26) operatively connected with the motor (24) and a housing (28) for enclosing the driveshaft (26). Further, an annular flow passage (30) is defined between the driveshaft (26) and the housing (28) for circulating drive fluid therethrough. More particularly, the driveshaft (26) has an outer surface (27) and the housing (28) has an inner surface (29). Preferably, the annular flow passage (30) is defined between the outer surface (27) of the driveshaft (26) and the inner surface (29) of the housing (28).

As described further below, the flow restrictor device (20) of the within invention restricts the flow of drive fluid through the motor (24) by restricting, either partially or fully, the circulation of drive fluid through the annular flow passage (30) between the driveshaft (26) and the housing (28).

The drilling assembly (20) has a proximal end for connection to a drill string and a distal end (32). The proximal end of the drilling assembly (20) is adapted for connection with the drill string, which drill string extends from the proximal end of the drilling assembly (20) to the surface. As a result, the application of an axial or compressive force to the drill string results in the axial movement or sliding of the drilling assembly (20) through the borehole and permits the application of weight on bit in order to perform the drilling operation.

The drilling assembly (20) is further comprised of a drilling bit (34) located at the distal end (32) of the drilling assembly (20) such that the distal end (32) of the drilling assembly (20) is defined thereby. The drilling bit (34) is provided for contacting the ground or formation in order to drill the borehole therein when weight is applied to the drilling bit (34) through the drill string and the drilling assembly (20).

Any drilling bit (34) capable of drilling the desired borehole may be used. However, preferably, the drilling bit (34) is a rotary drilling bit. The drilling bit (34) is operatively connected, either directly or indirectly, with the motor (24) such that the operation of the motor (24) by the circulation of the drive fluid actuates the drilling bit (34). More particularly, where the motor (24) comprises a rotor and stator, the rotation of the rotor within the stator by the circulation of the drive fluid therethrough directly or indirectly results in the rotation of the drilling bit (34) which is operatively connected therewith.

The flow restrictor device (22) may be located at any location or position within the drilling assembly (20) permitting the drive fluid to pass through both the motor (24) and the annular flow passage (30) defined between the driveshaft (26) and the housing (28). However, the device (22) is preferably located downhole or downstream of the motor (24) such that the drive fluid passes through the annular flow passage (30) after passing through the motor (24). In the preferred embodiment, the flow restrictor device (22) is located between the fluid driven motor (24) and the drilling bit (34). As a result, as described further below, when the flow restrictor device (22) is permitting a normal, relatively unrestricted flow of drive fluid, the drive fluid is circulated downhole through the motor (24), then through the annular flow passage (30) and through the drilling bit (34) to the end of the borehole.

Further, the driveshaft (26) has a proximal end (36) and a distal end (38). Preferably, the proximal end (36) of the driveshaft (26) is operatively connected, either directly or indirectly, with the fluid driven motor (24) such that actuation of the motor (24) drives the driveshaft (26). In the preferred embodiment, the proximal end (36) is connected with the rotor of the motor (24) such that rotation of the rotor within the stator causes a corresponding rotation of the driveshaft (26) within the housing (28). The connection may be by any mechanism, device or method for permanently or removably connecting, fastening or affixing the adjacent ends together, such as by a threaded connection, or they may be integrally formed together.

Further, the distal end (38) of the driveshaft (26) is operatively connected, either directly or indirectly, with the drilling bit (34) such that actuation of the driveshaft (26) drives the drilling bit (34). The connection may be by any mechanism, device or method for permanently or removably connecting, fastening or affixing the adjacent ends (38, 34) or they may be integrally formed together. However, preferably a threaded connection (39) is provided between the distal end (38) of the driveshaft 26) and the drilling bit (34). Therefore, in the preferred embodiment, rotation of the driveshaft (26) within the housing (28) causes a corresponding rotation of the drilling bit (34).

Thus, in the preferred embodiment, to operate the drilling assembly (20), a pressurized drive fluid is pumped into and circulated through the motor (24). The force of the pressurized circulating fluid being pumped through the motor (24) actuates the motor (24) and causes the driveshaft (26), which is operatively connected therewith, to rotate within the housing (28). The rotation of the driveshaft (26) within the housing (28) is transferred to the drilling bit (34) which is operatively connected thereto.

In other words, the hydraulic or pneumatic energy of the pressurized circulating fluid is converted by the motor (24) into the mechanical energy of the rotating driveshaft (26) and the attached drilling bit (34). Further, the bit rotation speed or rotations per minute ("RPM") of the drilling bit (34) is directly proportional to the circulating fluid flow rate in the motor (24). As a result, as explained previously, if the weight on bit is decreased during drilling operations for any reason, the decreased weight on bit typically results in a runaway condition caused by the sudden lowering of the pressure and consequent expansion of the compressed fluid, preferably the compressed gas or air, inside the drill string and the motor (24) normally present during the drilling mode or performance of the drilling operation.

This expansion of the fluid has a tendency to create excessive RPMs of the driveshaft (26). In other words, the decreased weight on bit reduces the torsional resistance to the rotor of the motor (24), which reduces the pressure resistance. The reduction in pressure resistance permits the expansion of the compressed fluid resulting in excessive motor speed and rotation of the driveshaft (26).

The flow restrictor device (22) is provided to address this circumstance. The flow restrictor device (22) may be actuated in any manner and by any method or mechanism such as in response to the circulation or lack of circulation of drive fluid through the annular flow passage (30) at a preset or predetermined pressure. However, in a preferred embodiment of the device (22), the device (22) is reactive to and actuated by the weight on bit.

In particular, preferably, a decrease in the weight on bit during the drilling operation beyond a preset or predetermined amount or magnitude actuates the flow restrictor device (22). Specifically, when weight on bit is applied for conducting the drilling operation, the device (22) permits the circulation of drive fluid through the annular flow passage (30) relatively unrestricted. Conversely, as the weight on bit is decreased to less than a desired or predetermined amount or magnitude, the device (22) restricts the circulation of drive fluid through the annular flow passage (30) either partially or completely.

The device (22) is comprised of a constricted section (40) in the annular flow passage (30) and an expanded section (42) in the annular flow passage (30). Further, the device (22) is comprised of a valve member (44) positioned in the annular flow passage (30). The valve member (44) is movable axially within the annular flow passage (30) between the constricted section (40) and the expanded section (42) to define a flow restricting position and a normal flow position. When the valve member (44) is in the flow restricting position, the circulation of drive fluid through the annular flow passage (30) is restricted. When the valve member (44) is in the normal flow position, the circulation of drive fluid through the annular flow passage (30) is relatively unrestricted, as compared with the flow restricting position.

The valve member (44) is in the flow restricting position when the flow of the drive fluid through the annular flow passage (30) is restricted either partially or fully. In the preferred embodiment, the restriction of the fluid flow tends to occur as the valve member (44) approaches or moves towards, adjacent to or within the constricted section (40) of the annular flow passage (30). Further, the valve member (44) is in the normal flow position when the flow of the drive fluid through the annular flow passage (30) is relatively unrestricted compared to the flow restricting position or is less restricted than the flow restricting position. In the preferred embodiment, unrestricted flow tends to occur as the valve member (44) approaches or moves towards, adjacent to or within the expanded section (42) of the annular flow passage (30).

The valve member (44) may be designed or configured to either partially restrict or fully restrict or block the flow of the drive fluid when in the flow restricting position. Further, as the valve member (44) approaches or moves towards or adjacent to the constricted section (40) of the annular flow passage (30), there may be a gradual restriction to the fluid flow.

In addition, the constricted section (40) and the expanded section (42) of the annular flow passage (30) may be defined by one or more portions or sections of the driveshaft (26), the housing (28) or both so long as the expanded section (42)

provides a flow area or cross-sectional area of flow greater than that of the constricted section (40) and the valve member (44) is permitted to move axially in the annular flow passage (30) between the constricted section (40) and the expanded section (42). However, preferably, the constricted section (40) of the annular flow passage (30) is defined by a section of the housing (28) having a reduced inner dimension relative to the inner dimension of the expanded section (42). In other words, an inner diameter of the expanded section (42), defined by the inner surface (29) of the housing (28) in the expanded section (42), is greater than an inner diameter of the constricted section (40), defined by the inner surface (29) of the housing (28) in the constricted section (40).

In addition to the motor (24), the driveshaft (26), the housing (28) and the drilling bit (34), the drilling assembly (20) may be comprised of any number of further components. For instance, the drilling assembly (20) may include a dump sub (not shown) above the motor (24), adjacent the proximal end of the drilling assembly (20). The dump sub may be incorporated into the drilling assembly (20) above the motor (24) or power unit primarily to allow the drill string to fill with fluid when tripping or running the drill string in the borehole and to allow the drill string to empty when tripping or running the drill string out of the borehole.

Further, a transmission unit (46) is typically located below the motor (24) to transmit torque and downthrust from the rotor (not shown) of the motor (24) to the driveshaft (26). As well, the driveshaft (26) typically extends through and is held concentrically by a bearing assembly (48) and a lower bearing sub (49) located above the drilling bit (34). Each of the bearing assembly (48) and the lower bearing sub (49) is comprised of one or more bearings, as described below, for supporting the driveshaft (26) therein.

Thus, starting at the proximal end and working towards the distal end (32) of the drilling assembly (20), the drilling assembly (20) typically includes the dump sub, the motor (24), the transmission unit (46), the bearing assembly (48), the lower bearing sub (49) and the drilling bit (34). However, it may include less components or any number of further components as desired or required for the particular drilling operation.

The driveshaft (26) extends from its proximal end (36) to its distal end (38). Typically, the proximal end (36) of the driveshaft (26) is connected with the rotor (not shown) of the motor (24) by a transmission shaft (not shown) and one or more articulated connections (not shown) which are located within the transmission unit (46). In this way, rotation of the rotor (not shown) is transmitted to the driveshaft (26) through the transmission shaft (not shown) and articulated connections (not shown).

The transmission unit (46) is further comprised of a transmission housing (50) having a proximal end and a distal end (52). The proximal end of the transmission housing (50) is connected with a housing comprising the motor (24). The housing of the motor (24) may be connected with the transmission housing (50) by any mechanism, device or method for permanently or removably connecting, fastening or affixing the adjacent ends together, such as by a threaded connection, or they may be integrally formed together. The distal end (52) of the transmission housing (50) is connected with the bearing assembly (48).

More particularly, the bearing assembly (48) is comprised of a bearing assembly housing (54) having a proximal end (56) and a distal end (58). The proximal end (56) of the bearing assembly housing (54) is connected with the distal end (52) of the transmission housing (50). The connection may be by any mechanism, device or method for permanently or removably connecting, fastening or affixing the adjacent ends (56, 52) together, such as by a threaded connection (60), or they may be integrally formed together. The distal end (58) of the bearing assembly housing (54) is connected with the lower bearing sub (49).

Again, more particularly, the lower bearing sub (49) is comprised of a lower bearing housing (61) having a proximal end (62) and a distal end (64). The proximal end (62) of the lower bearing housing (61) is connected with the distal end (58) of the bearing assembly housing (54). The connection may be by any mechanism, device or method for permanently or removably connecting, fastening or affixing the adjacent ends (62, 58) together, such as by a threaded connection (66), or they may be integrally formed together.

Figure 2:
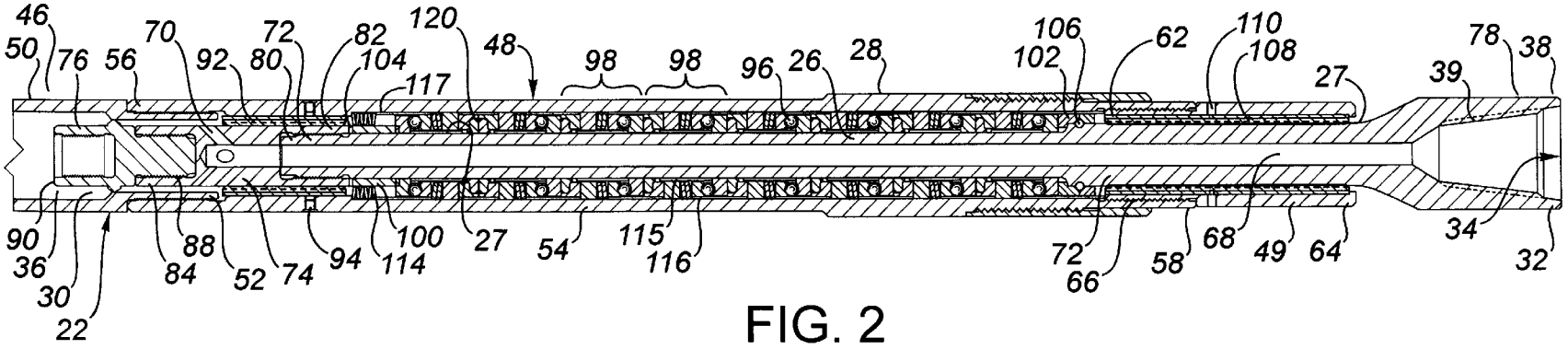
FIG. 2 is a detailed longitudinal sectional view of a portion of the drilling assembly shown in FIG. 1, showing the preferred embodiment of the drive fluid flow restrictor device.
Figure 3:
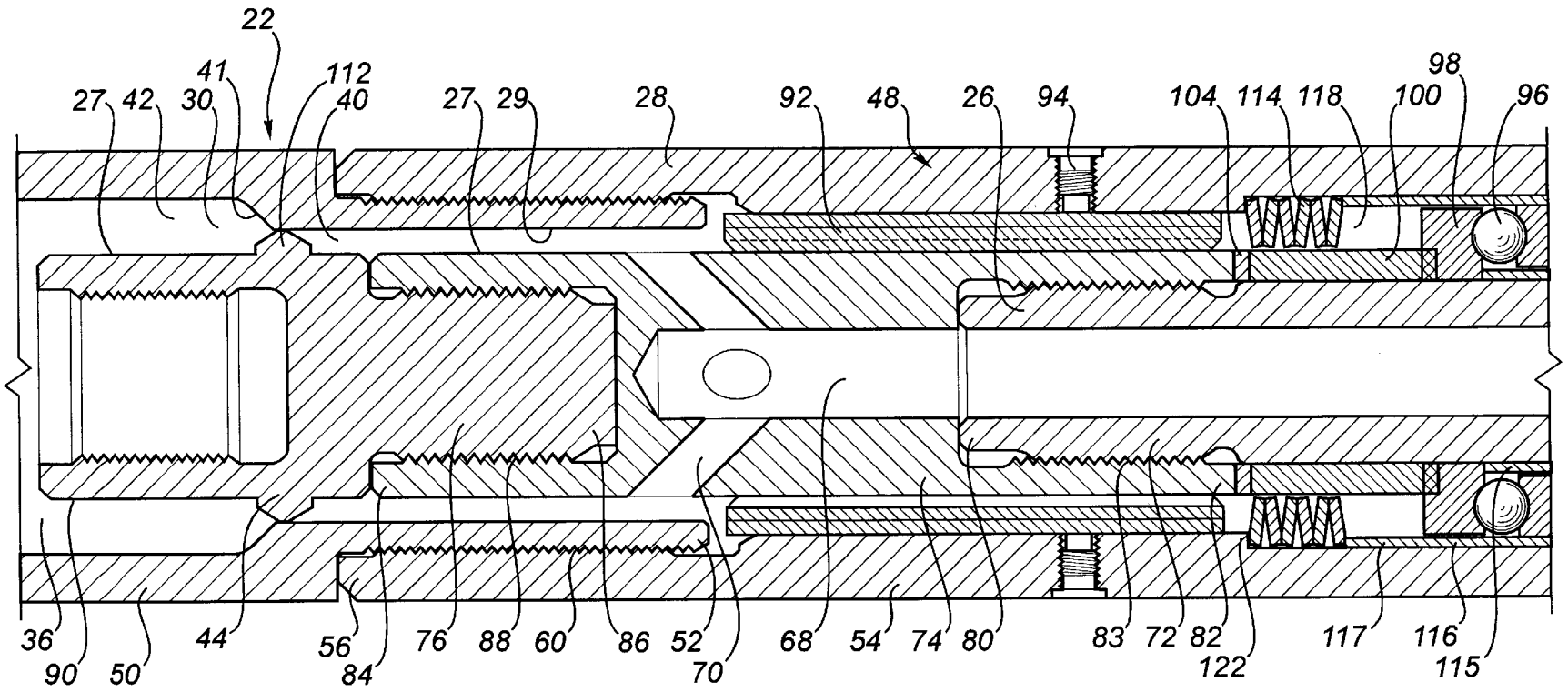
FIG. 3 is a detailed longitudinal sectional view of the drive fluid flow restrictor device shown in FIG. 2, wherein the driveshaft comprises a drive shaft cap and a restrictor cap.
Figure 4:
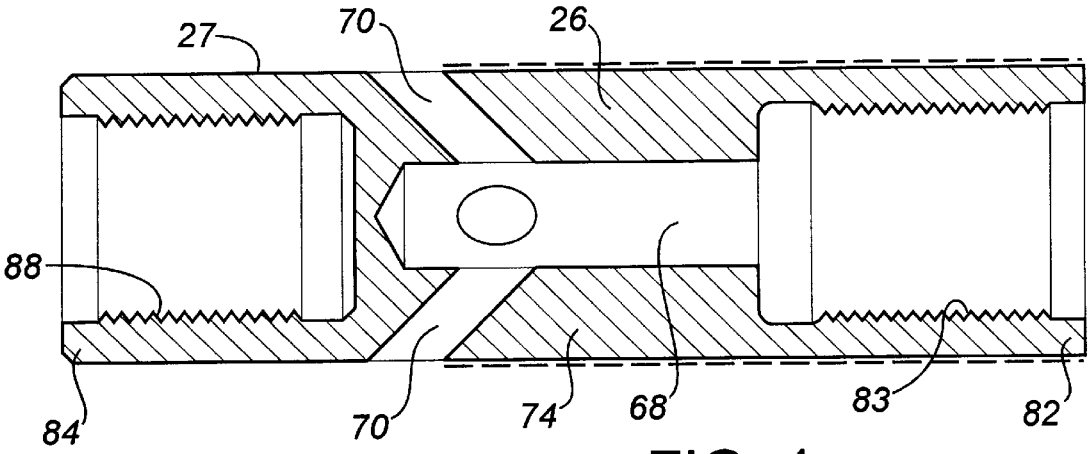
FIG. 4 is a longitudinal sectional view of the drive shaft cap shown in FIG. 3.
Figure 5:
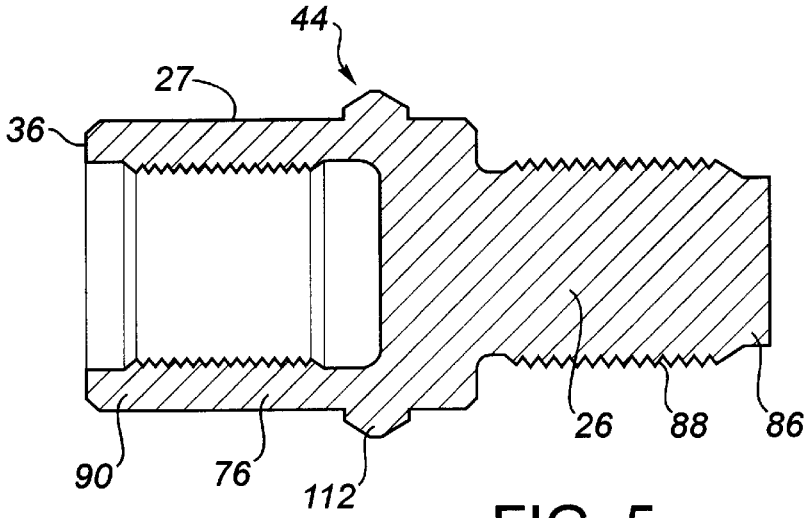
FIG. 5 is a longitudinal sectional view of the restrictor cap shown in FIG. 3.

As shown in FIGS. 1 through 3, the driveshaft (26) extends through and is enclosed, at least in part, by the housing (28) which is comprised of the transmission housing (50), the bearing assembly housing (54) and the lower bearing housing (61). Further, the proximal end (36) of the driveshaft (26) extends from the proximal end (56) of the bearing assembly housing (54) into the transmission housing (50) through its distal end (52) for connection with the motor (24). The distal end (38) of the driveshaft (26) extends through the lower bearing housing (61) and extends from its distal end (64) for connection with the drilling bit (34).

Further, the driveshaft defines a bore (68) extending from the distal end (38) through the driveshaft (26) towards the proximal end (36). Further, the driveshaft (26) defines one or more crossover ports (70) extending between the outer surface (27) of the driveshaft (26) and the bore (68) for the circulation of drive fluid therethrough. The crossover ports (70) permit the drive fluid to pass into the bore (68) of the driveshaft (26). As a result, the drive fluid may be expelled through the drilling bit (34) to flush out or clean the drilling bit (34) during drilling operations. In addition, components of the drilling assembly (20) that are not desirably exposed to the drive fluid or which are preferably exposed to a limited volume of drive fluid may be located downhole of such a crossover port (70) so that the majority of the volume of drive fluid is directed into the driveshaft (26) by the crossover port (70). For instance, the bearings comprising the bearing assembly (48) and the lower bearing sub (49) are preferably located downhole of the crossover ports (70).

As indicated previously, the driveshaft (26) may be comprised of any number of components connected together or may be comprised of a single integral unit. Referring to FIGS. 1 through 3, in the preferred embodiment, the driveshaft (26) is comprised of a lower driveshaft portion (72), a driveshaft cap (74) and a restrictor cap (76). A distal end (78) of the lower driveshaft portion (72) defines the distal end (38) of the driveshaft (26). A proximal end (80) of the lower driveshaft portion (72) is connected with a distal end (82) of the driveshaft cap (74). The connection may be by any mechanism, device or method for permanently or removably connecting, fastening or affixing the adjacent ends (80, 82) together, such as by a threaded connection (83), or they may be integrally formed together.

A proximal end (84) of the driveshaft cap (74) is connected with a distal end (86) of the restrictor cap (76). The connection may be by any mechanism, device or method for permanently or removably connecting, fastening or affixing the adjacent ends (84, 86) together, such as by a threaded connection (88), or they may be integrally formed together. Finally, a proximal end (90) of the restrictor cap (76) is connected with other components comprising the driveshaft (26) or directly with the motor (24).

In the preferred embodiment, the bore (68) of the driveshaft (26) extends through the lower driveshaft potion (72) and into the driveshaft cap (74), where the bore (68) communicates with the crossover ports (70). Thus, the driveshaft cap (74) defines the crossover ports (70).

The annular flow passage (30) is defined between the outer surface (27) of the driveshaft (26) and the inner surface (29) of the housing (28) and may be located anywhere along the length of the driveshaft (26) so long as the drive fluid is permitted to circulate therethrough upon operation of the motor (24). However, in the preferred embodiment, the annular flow passage (30) is located between the outer surface (27) of the driveshaft (26) and the inner surface (29) of the housing (28) adjacent to or in the proximity of the proximal end (36) of the driveshaft (26).

More preferably, the annular flow passage (30) is defined between the outer surface (27) of the driveshaft (26) and the inner surface (29) of the housing (28) at a location along the length of the driveshaft (26) above or uphole to the crossover ports (70) of the driveshaft (26). In other words, the annular flow passage (30) is located along the length of the driveshaft (26) between the proximal end (36) of the driveshaft (26) and the crossover ports (70). As a result, drive fluid is circulated from the motor (24) between the housing (28) and the driveshaft (26) through the annular flow passage (30), through the crossover ports (70) to the bore of the driveshaft (26), out the distal end (38) of the driveshaft (26) and through the drilling bit (34).

Further, in the preferred embodiment, the annular flow passage (30), including the constricted section (40) and the expanded section (42), are defined between the transmission housing (50) and the portion of the driveshaft (26) located therein or extending therethrough. More particularly, the annular flow passage (30) is defined between the transmission housing (50) and the restrictor cap (76) and driveshaft cap (74).

The constricted section (40) in the annular flow passage (30) is defined by a section of the transmission housing (50) having a reduced inner dimension relative to the inner dimension of the expanded section (42). Further, the constricted section (40) is preferably located at adjacent or in proximity to the distal end (52) of the transmission housing (50). The expanded section (42) communicates with the constricted section (40) and is located adjacent to the constricted section (40) uphole of the constricted section (40) or nearer to the proximal end of the transmission housing (50) than the constricted section (40). A shoulder (41) is provided between the constricted and expanded sections (40, 42), which may have any shape or configuration. However, the shoulder (41) preferably provides a gradual incline between the sections (40, 42) and is sloped inwardly in a downhole direction.

As indicated previously, the driveshaft (26) is supported within the housing (28), and in particular within the bearing assembly housing (54) and the lower bearing housing (61) by one or more bearings. These bearings preferably include a combination of thrust bearings, to support the downthrust of the rotor and the reactive upward loading from the applied weight on bit, and radial bearings, to absorb lateral side loading of the driveshaft (26). These bearings are located between the housing (28) and the driveshaft (26) and may be located at any location or position along the length of the driveshaft (26) permitting the bearing to perform its intended function.

The bearing assembly (48) is preferably comprised of an upper radial bearing (92) preferably located between the bearing assembly housing (54) and the driveshaft cap (74) adjacent the distal end (82) of the driveshaft cap (74). The upper radial bearing (92) is preferably maintained in position by fastening or affixing the bearing (92) to the bearing assembly housing (54) by any fastener or fastening device, such as one or more set screws (94).

Further, the bearing assembly (48) is comprised of a plurality of thrust bearings (96), preferably having a multistack ball and track design and preferably located between the bearing assembly housing (54) and the lower driveshaft portion (72). The thrust bearings (96) are preferably inserted as a plurality of stacked bearing cartridges (98) held in position between a driveshaft spacer ring (100) and a lower safety ring (102).

The driveshaft spacer ring (100) is located about the outer surface (27) of the lower driveshaft portion (72) between the uppermost bearing cartridge (98) and the distal end (82) of the driveshaft cap (74). The radial dimension or length of the driveshaft spacer ring (100) may be varied by one or more spacer shims (104) as necessary.

The lower safety ring (102) is located about the outer surface of the lower driveshaft portion (72) adjacent the threaded connection (66) between the distal end (58) of the bearing assembly housing (54) and the proximal end (62) of the lower bearing housing (61). The lower safety ring (102) is held in position by one or more lower safety pins (106) extending between the lower safety ring (102) and the outer surface (27) of the driveshaft (26).

Further, the lower bearing sub (49) is comprised of a lower radial bearing (108) located between the lower bearing housing (61) and the lower driveshaft portion (72). The lower radial bearing (108) is preferably maintained in position by fastening or affixing the bearing (108) to the lower bearing housing (61) by any fastener or fastening device, such as one or more set screws (110).

As indicated previously, the flow restrictor device (22) is comprised of the constricted section (40) in the annular flow passage (30), the expanded section (42) in the annular flow passage (30) and the valve member (44) positioned in the annular flow passage (30). The valve member (44) is movable axially in the annular flow passage (30) between the constricted section (40) and the expanded section (42) to define the flow restricting position and the normal flow position.

The valve member (44) may be positioned within the annular flow passage (30) in any manner and may have any shape or configuration permitting it to move axially therein. Further, the valve member (44) may be separate or distinct from both the driveshaft (26) and the housing (28) such that the valve member (44) is disposed between the driveshaft (26) and the housing (28). However, preferably, the valve member (44) is associated with either or both of the driveshaft (26) and the housing (28). More preferably, the valve member (44) is associated with only one of the driveshaft (26) or the housing (28). Specifically, the valve member (44) is most preferably associated with either the inner surface (29) of the housing (28) or the outer surface (27) of the driveshaft (26) adjacent to or defining the annular flow passage (30). In the preferred embodiment, the valve member (44) is associated with the outer surface (27) of the driveshaft (26), and more particularly, the outer surface (27) of the restrictor cap (76).

Further, the valve member (44) may be associated with either the driveshaft (26) or the housing (28) in any manner, however, this association is preferably by connecting, fastening, affixing or otherwise joining the valve member (44) with the driveshaft (26) or the housing (28) or by integrally forming the valve member (44) therewith. In the preferred embodiment, the valve member (44) is integrally formed with the driveshaft (26), and in particular, with the restrictor cap (76).

In addition, the valve member (44) may be comprised of any structure, mechanism or device movable axially within the annular flow passage (30) and able to restrict the circulation of drive fluid through the annular flow passage (30) when in the flow restricting position and to permit the circulation of drive fluid through the annular flow passage (30) relatively unrestricted when in the normal flow position. For instance, when the valve member (44) is disposed between the driveshaft (26) and the housing (28), the valve member (44) may be comprised of a valve mandrel located about the driveshaft (26) within the annular flow passage (30).

However, preferably, the valve member (44) is comprised of a projecting surface on either or both of the driveshaft (26) and the housing (28). Each projecting surface projects from the driveshaft (26) or the housing (28) towards the other of the driveshaft (26) or the housing (28). Thus, each projecting surface preferably projects into the annular flow space (30).

In the preferred embodiment, the valve member (44) is comprised of a projecting surface (112) on the driveshaft (26), preferably on the restrictor cap (76). The size and configuration of the projecting surface (112) may vary depending upon the desired result of the restrictor device (22). For instance, the projecting surface (112) may be sized and configured to partially restrict the flow of the drive fluid so that a limited or less than full volume or flow is permitted to pass thereby. Alternately, the projecting surface (112) may be sized and configured to completely restrict the flow of drive fluid so that the flow is fully blocked and no fluid is permitted to pass thereby.

The amount of drive fluid, if any, permitted to pass by the projecting surface (112) in the flow restricting position will depend upon, amongst other factor, the amount of space, if any, between the projecting surface (112) and the inner surface (29) of the housing (28) in the constricted section (40) in the annular flow passage (30). If desired, a seal or seals may be provided between the projecting surface (112) and the inner surface (29) of the housing (28) in the constricted section (40).

Further, the projecting surface (112) may be sized and configured, as desired, to be permitted to move within the constricted section (40). For instance, the radial dimension of the projecting surface (112) may be such that the projecting surface (112) may pass within the constricted section (40) in the annular flow passage (30) to restrict the circulation of drive fluid through the annular flow passage (30). Alternately, the radial dimension of the projecting surface (112) may be such that the projecting surface (112) is not permitted to pass within the constricted section (40) in the annular flow passage (30). Rather, the projecting surface (112) may abut or move into proximity to the shoulder (41) between the constricted and expanded sections (40, 42) to restrict the circulation of drive fluid through the annular flow passage (30).

The valve member (44) may move between the flow restricting position and the normal position in the annular flow passage (30) in any manner and by any mechanism or method of actuation. For instance, where the valve member (44) is disposed between the driveshaft (26) and the housing (28), the valve member (44) may move between the flow restricting position and the normal flow position as a result of axial movement of the valve member (44) relative to both the driveshaft (26) and the housing (28). The relative axial movement may occur in any manner and may be a result of any mechanism or method of actuation. For instance, this relative axial movement may be a result of the circulation or the lack of circulation of drive fluid through the annular flow passage or a result of an increase or decrease of the weight on bit.

For example, where the valve member (44) is disposed between the driveshaft (26) and the housing (28), the valve member (44) may be capable of axial movement relative to both the driveshaft (26) and the housing (28) between a distal valve mandrel position, defining one of the flow restricting position and the normal flow position, and a proximal valve mandrel position, defining the other of the flow restricting position and the normal flow position. The valve mandrel (44) is preferably biased toward the flow restricting position.

However, in the preferred embodiment, the valve member (44) moves between the flow restricting position and the normal flow position in the annular flow passage (30) as a result of axial movement of the driveshaft (26) relative to the housing (28). The relative axial movement between the driveshaft (26) and the housing (28) may occur in any manner and may be a result of any mechanism or method of actuation. For instance, this relative axial movement may be a result of the circulation or the lack of circulation of drive fluid through the annular flow passage. However, preferably, the relative axial movement is a result of an increase or decrease of the weight on bit.

In the preferred embodiment, the driveshaft (26) is capable of axial movement relative to the housing (28) between an extended driveshaft position, as shown in FIGS. 1 through 3, and a retracted driveshaft position. Specifically, the valve member (44) is in the flow restricting position when the driveshaft (26) is in the extended driveshaft position and the valve member (44) is in the normal flow position when the driveshaft (26) is in the retracted driveshaft position.

Thus, in the extended driveshaft position, as shown in FIGS. 1 through 3, the valve member (44), and in particular the projecting surface (112) of the restrictor cap (76), is moved towards the constricted section (40) in the annular flow passage (30) to the flow restricting position. More particularly, the projecting surface (112) abuts or engages either the shoulder (41) of the inner surface (29) of the transmission housing (50) between the constricted and expanded sections (40, 42) or the inner surface (29) of the transmission housing (50) at or within the constricted section (40).

Conversely, in the retracted driveshaft position, the valve member (44), and in particular the projecting surface (112) of the restrictor cap (76), is moved towards the expanded section (42) in the annular flow passage (30) to the normal flow position. In this position, the projecting surface (112) is a sufficient distance from the constricted section (40) such that the circulation of drive fluid through the annular flow passage (30) is relatively unrestricted.

The driveshaft (26) is preferably biased toward the extended driveshaft position. Any biasing mechanism, structure or device for urging the driveshaft (26) towards the extended driveshaft position may be used. However, in the preferred embodiment, the biasing mechanism is comprised of one or more springs, preferably a plurality of Belleville springs (114).

As shown in FIGS. 1 through 3, each bearing cartridge (98) preferably includes an inner stationary race (115) and an outer stationary race (116). Each race (115, 116) includes an axially projecting portion (117) extending from opposing ends of the cartridge (98) for facilitating the mounting together or stacking of the cartridges (98) within the bearing assembly (48). The uppermost bearing cartridge (98) is stacked in a manner such that the axially projecting portion (117) of the outer race (116) of the cartridge (98) extends from the cartridge (98) into a space (118) provided by the driveshaft spacer ring (100) between the uppermost bearing cartridge (98) and the driveshaft cap (74). If necessary, an inverter ring (120) may be used to provide for the proper stacking or placement of the outer race (116) of the uppermost bearing cartridge (98).

As shown in FIG. 3, the preloaded Belleville springs (114) are located within the space (118) provided by the driveshaft spacer ring (100) between the uppermost bearing cartridge (98) and the driveshaft cap (74). More particularly, the Belleville springs (114) are maintained between, and act upon, the projecting portion (117) of the outer stationary race (116) of the uppermost bearing cartridge (98) and a downwardly directed shoulder (122) provided within the space (118) by the inner surface (29) of the bearing assembly housing (54). As a result, the Belleville springs (114) act upon the outer stationary races (116) of the bearing cartridges (98) to urge the bearing cartridges (98) downwards or in a downhole direction. The lowermost bearing cartridge (98) similarly acts upon the lower safety ring (102) which is connected with or affixed to the driveshaft (26). As a result, the driveshaft (26) is urged towards the extended driveshaft position.

The number and type of Belleville springs (114) is selected to provide a predetermined spring force. The spring force is selected depending upon the weight on bit desired to be applied to permit the drilling operation to be conducted. More particularly, the application of a weight on bit sufficient to overcome the spring force of the Belleville springs (114) will move the valve member (44) of the restrictor device (22) to the normal flow position, thus permitting the drilling operation to proceed. Conversely, the application of a weight on bit insufficient to overcome the spring force will result in the maintenance of the valve member (44) in the flow restricting position.

Thus, in the preferred embodiment, when a sufficient or predetermined or preset weight is applied to the drilling bit (34) during drilling operations, the driveshaft (26) is moved axially relative to the housing (28) towards the retracted driveshaft position. Thus, the valve member (44) of the restrictor device (22) is in the normal flow position permitting circulation of drive fluid through the annular flow passage (30) relatively unrestricted. Conversely, when an insufficient or less than a predetermined or preset weight is applied to the drilling bit (34), the driveshaft (26) is moved axially relative to the housing (28) towards the extended driveshaft position. Thus, the valve member (44) is in the flow restricting position restricting circulation of drive fluid through the annular flow passage (30), either partially or completely.

As a result, when the drill string is lifted within the borehole to reduce the weight on bit or the weight on bit is drilled off, the restrictor device (22) will restrict the flow of drive fluid through the motor (24) and thus prevent or control the generation of excessive RPMs of the driveshaft (26).

The embodiments of the invention in which an exclusive privilege or property is claimed are defined as follows:

1. In a drilling assembly of the type comprising a fluid driven motor, a driveshaft operatively connected with the motor, a housing for enclosing the driveshaft and an annular flow passage defined between the driveshaft and the housing for circulating drive fluid therethrough, the improvement comprising a drive fluid flow restrictor device, the device comprising:

(a) a constricted section in the annular flow passage;

(b) an expanded section in the annular flow passage; and (c) a valve member positioned in the annular flow passage, the valve member being movable axially in the annular flow passage between the constricted section and the expanded section to define a flow restricting position and a normal flow position;

such that when the valve member is in the flow restricting position the circulation of drive fluid through the annular flow passage is restricted and such that when the valve member is in the normal flow position the circulation of drive fluid through the annular flow passage is relatively unrestricted.

2. The device as claimed in claim 1 wherein the valve member is associated with either the driveshaft or the housing.

3. The device as claimed in claim 2 wherein the valve member is integrally formed with either the drive shaft or the housing.

4. The device as claimed in claim 2 wherein the valve member is comprised of a projecting surface on the driveshaft.

5. The device as claimed in claim 4 wherein the constricted section of the annular flow passage is defined by a section of the housing having a reduced inner dimension relative to the inner dimension of the expanded section.

6. The device as claimed in claim 2 wherein the valve member moves between the flow restricting position and the normal flow position in the annular flow passage as a result of axial movement of the driveshaft relative to the housing.

7. The device as claimed in claim 6 wherein the driveshaft is capable of axial movement relative to the housing between an extended driveshaft position and a retracted driveshaft position, wherein the valve member is in the restricted flow position when the driveshaft is in the extended driveshaft position, and wherein the valve member is in the normal flow position when the driveshaft is in the retracted driveshaft position.

8. The device as claimed in claim 7 wherein the driveshaft is biased toward the extended driveshaft position.

9. The device as claimed in claim 7 wherein the drilling assembly is further comprised of a drilling bit located at a distal end of the drilling assembly and wherein the device is located between the fluid driven motor and the drilling bit.

10. The device as claimed in claim 5 wherein the valve member moves between the flow restricting position and the normal flow position in the annular flow passage as a result of axial movement of the driveshaft relative to the housing.

11. The device as claimed in claim 10 wherein the driveshaft is capable of axial movement relative to the housing between an extended driveshaft position and a retracted driveshaft position, wherein the valve member is in the restricted flow position when the driveshaft is in the extended driveshaft position, and wherein the valve member is in the normal flow position when the driveshaft is in the retracted driveshaft position.

12. The device as claimed in claim 11 wherein the driveshaft is biased toward the extended driveshaft position.

13. The device as claimed in claim 11 wherein the drilling assembly is further comprised of a drilling bit located at a distal end of the drilling assembly and wherein the device is located between the fluid driven motor and the drilling bit.

* * * * *